US012644164B2

(12) United States Patent
Kataoka et al.

(10) Patent No.: US 12,644,164 B2
(45) Date of Patent: Jun. 2, 2026

(54) PRODUCTION METHOD FOR GRAIN-ORIENTED ELECTRICAL STEEL SHEET

(71) Applicant: NIPPON STEEL CORPORATION, Tokyo (JP)

(72) Inventors: Takashi Kataoka, Tokyo (JP); Haruhiko Atsumi, Tokyo (JP); Ryutaro Yamagata, Tokyo (JP); Nobusato Morishige, Tokyo (JP); Kazutoshi Takeda, Tokyo (JP)

(73) Assignee: NIPPON STEEL CORPORATION, Tokyo (JP)

( * ) Notice: Subject to any disclaimer, the term of this patent is extended or adjusted under 35 U.S.C. 154(b) by 701 days.

(21) Appl. No.: 18/008,927

(22) PCT Filed: Jun. 23, 2021

(86) PCT No.: PCT/JP2021/023789
§ 371 (c)(1),
(2) Date: Dec. 7, 2022

(87) PCT Pub. No.: WO2021/261518
PCT Pub. Date: Dec. 30, 2021

(65) Prior Publication Data

US 2023/0243010 A1 Aug. 3, 2023

(30) Foreign Application Priority Data

Jun. 24, 2020 (JP) ..... 2020-108603

(51) Int. Cl.

| | |
|---|---|
| ***C21D 9/46*** | (2006.01) |
| ***C21D 3/04*** | (2006.01) |
| ***C21D 8/1216*** | (2026.01) |
| ***C21D 8/1244*** | (2026.01) |
| ***C21D 8/1277*** | (2026.01) |
| ***C22C 38/00*** | (2006.01) |
| ***C22C 38/02*** | (2006.01) |
| ***C22C 38/04*** | (2006.01) |
| ***C22C 38/06*** | (2006.01) |
| ***C22C 38/16*** | (2006.01) |
| ***C22C 38/60*** | (2006.01) |

(52) U.S. Cl.
CPC ..... *C21D 8/1283* (2013.01); *C21D 3/04* (2013.01); *C21D 8/1222* (2013.01); *C21D 8/1272* (2013.01); *C21D 9/46* (2013.01); *C22C 38/001* (2013.01); *C22C 38/002* (2013.01); *C22C 38/02* (2013.01); *C22C 38/04* (2013.01); *C22C 38/06* (2013.01); *C22C 38/16* (2013.01); *C22C 38/60* (2013.01); *C21D 2201/05* (2013.01)

(58) Field of Classification Search
CPC ..... C21D 9/46
See application file for complete search history.

(56) References Cited

U.S. PATENT DOCUMENTS

| | | | | |
|---|---|---|---|---|
| 2015/0243419 | A1 | 8/2015 | Senda et al. | |
| 2016/0111190 | A1* | 4/2016 | Boettcher | H01F 41/02 148/111 |
| 2019/0271054 | A1 | 9/2019 | Ehashi et al. | |

FOREIGN PATENT DOCUMENTS

| | | | |
|---|---|---|---|
| CN | 108699621 | A | 10/2018 |
| JP | 7-268567 | A | 10/1995 |
| JP | 2019-163519 | A | 9/2019 |
| WO | WO2014/049770 | A1 | 4/2014 |

OTHER PUBLICATIONS

U.S. Appl. No. 18/009,919, filed Dec. 12, 2022.

* cited by examiner

*Primary Examiner* — Jophy S. Koshy
(74) *Attorney, Agent, or Firm* — Birch, Stewart, Kolasch & Birch, LLP

(57) ABSTRACT

Provided is a production method for a grain-oriented electrical steel sheet that is thin and has excellent magnetic characteristics. An embodiment of the present invention provides a production method that is for a grain-oriented electrical steel sheet and that comprises: a hot rolling step; an optional hot-rolled sheet-annealing step; an acid-washing step; a cold rolling step; a primary recrystallization-annealing step; a finishing-annealing step; and a planarization-annealing step. In the acid-washing step, an acid-washing solution containing 0.0001-5.00 g/L of Cu is used. The thickness of a cold-rolled steel sheet is 0.15-0.23 mm. The average temperature increase rate in the temperature range of 30-400° C. in a temperature increase process in the primary recrystallization step is more than 50° C./sec but not more than 1000° C./sec.

14 Claims, No Drawings

PRODUCTION METHOD FOR GRAIN-ORIENTED ELECTRICAL STEEL SHEET

FIELD

The present invention relates to a method for producing grain-oriented electrical steel sheet.

BACKGROUND

Grain-oriented electrical steel sheet is steel sheet which contains Si in 2 mass % to 5 mass % or so and has crystal grains of the steel sheet integrated in orientation to a high degree to the {110}<001> orientation called the "Goss orientation". Grain-oriented electrical steel sheet is excellent in magnetic characteristics, so, for example, is utilized as the core material of transformers and other stationary induction apparatus etc. In the past, various techniques have been developed for improving the magnetic characteristics of electrical steel sheet. In particular, along with the demands for energy-saving in recent years, further reduction of the core loss has been sought in grain-oriented electrical steel sheet. For reducing the core loss of grain-oriented electrical steel sheet, raising the integration degree of the orientation of the crystal grains of the steel sheet to the Goss orientation to improve the magnetic flux density and reduce the hysteresis loss is effective. In the production of grain-oriented electrical steel sheet, the crystal orientation is controlled by utilizing the catastrophic grain growth phenomenon called "secondary recrystallization". To suitably control the crystal orientation by secondary recrystallization, it is important to secure uniform precipitation and thermal stability of the microprecipitates in the steel called "inhibitors".

The art of suitably controlling the secondary recrystallization to produce low core loss grain-oriented electrical steel sheet has been variously proposed. For example, PTL 1 discloses the art of controlling the heat pattern in the temperature raising process in primary recrystallization annealing to produce grain-oriented electrical steel sheet lowered in core loss over the entire length of the coil. Furthermore, PTL 2 discloses the art of strictly controlling the average grain size of the crystal grains after secondary recrystallization and the angle of deviation from the ideal orientation to reduce the core loss of grain-oriented electrical steel sheet.

CITATIONS LIST

Patent Literature

[PTL 1] WO2014/049770

[PTL 2] Japanese Unexamined Patent Publication No. 7-268567

SUMMARY

Technical Problem

The success of secondary recrystallization of grain-oriented electrical steel sheet is determined by the balance of the frequency of Goss orientation and the thermal stability of precipitates in the steel (inhibitors) in the steel sheet after decarburization and before finish annealing. In general, if raising the rate of temperature rise at the time of primary recrystallization annealing, the amount of Goss-oriented grains increases and the magnetic characteristics are improved. However, according to studies of the inventors, in thin materials (in one aspect, sheets of thickness of 0.23 mm or less), compared with thick materials, the effect of improvement of the magnetic characteristics due to the increase in the rate of temperature rise tends to be small. In the past, no method for producing grain-oriented electrical steel sheet excellent in magnetic characteristics in which, while thin, the effect of improvement of the magnetic characteristic due to the increase in the rate of temperature rise has been manifested well has been provided.

Therefore, the present invention has as its object to solve the above problem and provide a method for producing grain-oriented electrical steel sheet enabling production of grain-oriented electrical steel sheet which is thin and yet excellent in magnetic characteristics.

Solution to Problem

The present invention encompasses the following aspects:

[1] A method for producing grain-oriented electrical steel sheet including

- a hot rolling process of heating and hot rolling a slab having a slab composition comprising, by mass %, C: 0.02% or more and 0.10% or less, Si: 2.5% or more and 4.5% or less, Mn: 0.01% or more and 0.30% or less, a total of one or both of S and Se: 0.001% or more and 0.050% or less, acid soluble Al: 0.01% or more and 0.05% or less, N: 0.002% or more and 0.020% or less, P: 0.0400% or less, and Cu: 0.05% or more and 0.50% or less and having a balance of Fe and impurities to obtain hot rolled steel sheet,
- a process of dipping the hot rolled steel sheet in a pickling solution or annealing the hot rolled steel sheet to obtain hot rolled annealed sheet, then dipping the hot rolled annealed sheet in a pickling solution to obtain a pickled sheet,
- a cold rolling process of cold rolling the pickled sheet to obtain a cold rolled steel sheet,
- a primary recrystallization annealing process of annealing the cold rolled steel sheet for primary recrystallization to obtain a primary recrystallized annealed sheet,
- a finish annealing process of coating a surface of the primary recrystallized annealed sheet by an annealing separator containing MgO, then finish annealing the sheet to obtain a finish annealed sheet, and
- a flattening annealing process of coating the finish annealed sheet with an insulation coating, then annealing it for flattening,
- the pickling solution containing Cu in 0.0001 g/L or more and 5.00 g/L or less,
- a thickness of the cold rolled steel sheet being 0.15 mm or more and 0.23 mm or less, and
- the primary recrystallization annealing process including a temperature raising process and a decarburization annealing process, an average rate of temperature rise of a temperature region of 30° C. to 400° C. in the temperature raising process being more than 50° C./s and 1000° C./s or less.

[2] A method for producing grain-oriented electrical steel sheet according to [1], wherein a total content of Cu and Mn in the pickling solution is 0.01 g/L or more and 5.00 g/L or less.

[3] A method for producing grain-oriented electrical steel sheet according to [1] or [2], wherein in the pickling process, a pH of the pickling solution is −1.5 or more and less than 7.0, a solution temperature is 15° C. or more and 100° C. or less, and the dipping is performed for 5 seconds or more and 200 seconds or less.

[4] A method for producing grain-oriented electrical steel sheet according to any one of [1] to [3], wherein the pickling solution contains Ni: 0.01 g/L or more and 5.00 g/L or less.

[5] A method for producing grain-oriented electrical steel sheet according to any one of [1] to [4], wherein in the temperature raising process in the primary recrystallization annealing process, a dew point in the temperature region of 30° C. to 800° C. is −50° C. to 0° C.

[6] A method for producing grain-oriented electrical steel sheet according to any one of [1] to [5], wherein an average rate of temperature rise in a temperature region of 550° C. to 700° C. in the temperature raising process is 100° C./s or more and 3000° C./s or less.

[7] A method for producing grain-oriented electrical steel sheet according to any one of [1] to [6] wherein an average rate of temperature rise in a temperature region of 700° C. to 800° C. in the temperature raising process is 400° C./s or more and 2500° C./s or less.

[8] A method for producing grain-oriented electrical steel sheet according to any one of [1] to [7], where the decarburization annealing process includes soaking treatment performed at a temperature of 750° C. to 900° C. in an atmosphere of an oxygen potential ($P_{H_2O}/P_{H_2}$) of 0.2 to 0.6.

[9] A method for producing grain-oriented electrical steel sheet according to [8], wherein the decarburization annealing process includes a first soaking treatment performed at a temperature of 750° C. to 900° C. in an atmosphere of an oxygen potential ($P_{H_2O}/P_{H_2}$) of 0.2 to 0.6 and a second heat treatment performed after the first heat treatment at a temperature of 900° C. to 1000° C. in an atmosphere of an oxygen potential ($P_{H_2O}/P_{H_2}$) of less than 0.2.

[10] A method for producing grain-oriented electrical steel sheet according to any one of [1] to [9], performing nitriding after the cold rolling process and before the finish annealing process.

[11] A method for producing grain-oriented electrical steel sheet according to any one of [1] to [10], wherein the slab composition contains, in place of part of the Fe, by mass %, one or more elements selected from the group consisting of
Sn: 0.50% or less,
Cr: 0.500% or less,
Bi: 0.0200% or less,
Sb: 0.500% or less,
Mo: 0.500% or less, and
Ni: 0.500% or less.

Advantageous Effects of Invention

According to one aspect of the present invention, a method for producing grain-oriented electrical steel sheet which is thin and yet excellent in magnetic characteristics can be provided.

DESCRIPTION OF EMBODIMENTS

Below, an illustrative embodiment of the present invention will be explained, but the present invention is not limited to the following embodiment. Note that, unless otherwise indicated, the expression "A to B" for the numerical values A and B will mean "A or more and B or less".

One aspect of the present invention provides a method for producing grain-oriented electrical steel sheet including a hot rolling process of heating and hot rolling a slab having a slab composition comprising, by mass %, C: 0.02% or more and 0.10% or less, Si: 2.5% or more and 4.5% or less, Mn: 0.01% or more and 0.30% or less, a total of one or both of S and Se: 0.001% or more and 0.050% or less, acid soluble Al: 0.01% or more and 0.05% or less, N: 0.002% or more and 0.020% or less, P: 0.0400% or less, and Cu: 0.05% or more and 0.50% or less and having a balance of Fe and impurities to obtain hot rolled steel sheet, a process of dipping the hot rolled steel sheet in a pickling solution or annealing the hot rolled steel sheet to obtain hot rolled annealed sheet, then dipping the hot rolled annealed sheet in a pickling solution to obtain a pickled sheet, a cold rolling process of cold rolling the pickled sheet to obtain a cold rolled steel sheet, a primary recrystallization annealing process of annealing the cold rolled steel sheet for primary recrystallization to obtain a primary recrystallized annealed sheet, a finish annealing process of coating a surface of the primary recrystallized annealed sheet by an annealing separator containing MgO, then finish annealing the sheet to obtain a finish annealed sheet, and a flattening annealing process of coating the finish annealed sheet with an insulation coating, then annealing it for flattening.

In one aspect, the pickling solution contains Cu in 0.0001 g/L or more and 5.00 g/L or less. In one aspect, a total content of Cu and Mn in the pickling solution is 0.01 g/L or more and 5.00 g/L or less.

If establishing the presence of constituents functioning as inhibitors at the time of finish annealing (typically, MnS, MnSe, and AlN) in the steel, holding the inhibitors without breaking down until a predetermined temperature at the time of finish annealing is important for the desired secondary recrystallization. However, according to the study of the inventors, if the thickness of the steel sheet supplied for the finish annealing is small (that is, if the sheet is thin), the effect of increase of the Goss orientation by raising the rate of temperature rise at the time of the primary recrystallization annealing tends to be small. While not desirable to be bound by theory, in a thin material, a reaction breaking down the inhibitors easily occurs due to the size of the surface area and there is a good possibility that the effect of increase of the Goss orientation will not be able to be sufficiently enjoyed. That is, to make the effect of increase of the Goss orientation be sufficiently obtained in a thin material, just raising the rate of temperature rise at the time of the primary recrystallization annealing is not sufficient. It is necessary to take measures for stabilizing the inhibitors. For example, MnS is broken down by a reaction of MnS→Mn+S whereby S is discharged outside of the system as a gas, so at the time of finish annealing, control for reducing the gas permeability is required.

The inventors realized improvement in the magnetic characteristics (magnetic flux density and core loss) of thin materials, the object of the present invention, by making the slab contain Cu in 0.05% or more and by controlling the pickling conditions of the hot rolled steel sheet or hot rolled annealed sheet. The inventors analyzed the steel slab after hot rolled annealing and after pickling, whereupon they discovered the possibility that a layer of Cu or Mn or in some cases Ni segregated at the surface (below, sometimes referred to as a "3d transition metal segregated layer") is formed at the surface of the sample. More specifically, the inventors analyzed the steel slab by glow discharge emission spectroscopy (GDS) whereupon, at the surface of the sample, emission intensities derived from the above such 3d transition metals were observed by the peaks, so the presence of the surface segregated layer was surmised. Note that in this analysis, emission peaks of light elements which might conceivably bond with the 3d transition metals, such as oxygen or nitrogen, could not be confirmed at the sample surface, so it is surmised that the 3d transition metals were segregated there not as compounds, but as metals alone. This 3d transition metal segregated layer may conceivably result from the Cu or Mn or other 3d transition metals contained in the steel dissolving out into the acid solution during pickling and then reprecipitating due to some reason or another. If there is a 3d transition metal segregated layer present at the surface of the steel sheet, the gas permeability of the steel sheet may be remarkably decreased. Conversely speaking, the release of gas from inside the steel is also suppressed. For example, the inhibitor MnS breaks down as MnS→Mn+S and S is released outside of the steel as a gas. Here, if there is a 3d transition metal segregated layer present at the surface of the steel sheet and reducing the gas permeability, the generation of S gas will be suppressed (that is, the active amount of S dissolved in the steel will increase). At the same time as the generation of S gas being suppressed, the above reaction of MnS→Mn+S is also suppressed. This in turn leads to thermal stability of the MnS.

As the metal constituents made to be contained in the pickling solution, from the viewpoint of the ease of precipitation at the surface of the steel sheet and the lighter load on the environment, 3d transition metals (Sc, Ti, V, Cr, Mn, Fe, Co, Ni, Cu, and Zn) are advantageous. The particularly preferable 3d transition metals are Cu, Mn, and/or Ni, but if 3d transition metals, the effect of thermal stabilization of the MnS can be exhibited, so Sc, Ti, V, Co, Cr, and Zn are also preferable as 3d transition metals. Therefore, the pickling solution, in one aspect, includes one or more types of metal selected from the group consisting of Sc, Ti, V, Cu, Mn, Ni, Co, Cr, and Zn, more advantageously includes one or more types of metal selected from the group consisting of Cu, Mn, and Ni, still more advantageously includes one or both types of metal selected from the group consisting of Cu and Mn, particularly advantageously includes Cu and optionally Mn. Where the 3d transition metals in the pickling solution are derived from does not matter. That is, they may be constituents in the steel dissolved into the pickling solution or may be 3d transition metals intentionally made to be contained in the pickling solution.

In one aspect, the Cu content in the pickling solution is 0.0001 g/L or more from the viewpoint of the effect of its precipitating well at the surface of the steel sheet and suppressing breakdown of the inhibitors being exhibited well. Further, in one aspect, it is 5.00 g/L or less from the viewpoint of preventing inconveniences at the time of primary recrystallization due to excessive precipitation of metal constituents (insufficient decarburization, insufficient formation of oxide film, etc.) That is, the Cu content in the pickling solution is, in one aspect, 0.0001 g/L or more and 5.00 g/L or less, preferably 0.005 g/L or more and 5.00 g/L or less, more preferably 0.01 g/L or more and 5.00 g/L or less, still more preferably 0.02 g/L or more and 4.00 g/L or less, and further preferably 0.03 g/L or more and 2.00 g/L or less.

In one aspect, the total content of the Cu and Mn in the pickling solution is preferably 0.01 g/L or more from the viewpoint of the effect of their precipitating well at the surface of the steel sheet and suppressing breakdown of the inhibitors being exhibited well. Preferably it is 5.00 g/L or less from the viewpoint of preventing inconveniences at the time of primary recrystallization due to excessive precipitation of metal constituents (insufficient decarburization, insufficient formation of oxide film, etc.) The total content of the Cu and Mn in the pickling solution is preferably 0.01 g/L or more and 5.00 g/L or less, more preferably 0.02 g/L or more and 4.00 g/L or less, and still more preferably 0.03 g/L or more and 2.00 g/L or less.

The Ni content in the pickling solution is preferably 0.01 g/L or more and 5.00 g/L or less, more preferably 0.02 g/L or more and 4.00 g/L or less, and further preferably 0.03 g/L or more and 2.00 g/L or less.

The amounts of the metal constituents in the pickling solution can be measured using ICP-AES (Inductively Coupled Plasma-Atomic Emission Spectrometry).

According to the method of the present embodiment, it is possible to achieve excellent thermal stability of the inhibitors not only in thick materials, but also in thin materials, so the advantages due to the method of the present embodiment are particularly remarkable in the production of grain-oriented electrical steel sheet using thin materials. The thickness of the cold rolled steel sheet in the method of the present embodiment is, in one aspect, 0.23 mm or less, less than 0.23 mm, or 0.22 mm or less. The thickness of the cold rolled steel sheet can be made 0.15 mm or more, 0.16 mm or more, 0.17 mm or more, or 0.18 mm or more in one aspect in accordance with the desired application of the grain-oriented electrical steel sheet.

Below, the method for producing the grain-oriented electrical steel sheet according to the present embodiment will be specifically explained.

Chemical Composition of Slab

First, the chemical composition of the slab used for the grain-oriented electrical steel sheet according to the present embodiment will be explained. Note that, below, unless otherwise indicated, the expression "%" will be assumed to express "mass %". Further, the balance of the slab other than the elements explained below is Fe and impurities.

The content of C (carbon) is 0.02% or more and 0.10% or less. C plays various roles, but if C is less than 0.02%, at the time of heating the slab, the grain size becomes excessively large, whereby the core loss value of the final grain-oriented electrical steel sheet is made to increase, so this is not preferable. If the content of C is more than 0.10%, at the time of decarburization after cold rolling, the decarburization time becomes long and the production costs increase, so this is not preferable. Further, if the content of C is more than 0.10%, the decarburization easily becomes incomplete and there is a possibility of magnetic aging occurring in the final grain-oriented electrical steel sheet, so this is not preferable. Therefore, the content of C is 0.02% or more and 0.10% or less, preferably 0.04% or more and 0.09% or less, more preferably 0.05% or more and 0.09% or less.

The content of Si (silicon) is 2.5% or more and 4.5% or less. Si raises the electrical resistance of the steel sheet to thereby reduce the eddy current loss—which is one of the causes of core loss. If the content of Si is less than 2.5%, it becomes difficult to sufficiently suppress the eddy current loss of the final grain-oriented electrical steel sheet, so this is not preferable. If the content of Si is more than 4.5%, the workability of the grain-oriented electrical steel sheet falls, so this is not preferable. Therefore, the content of Si is 2.5% or more and 4.5% or less, preferably 2.7% or more and 4.0% or less, more preferably 3.2% or more and 3.7% or less.

The content of Mn (manganese) is 0.01% or more and 0.30% or less. Mn forms the inhibitors MnS, MnSe, etc. governing the secondary recrystallization. If the content of Mn is less than 0.01%, the absolute amounts of MnS and MnSe causing the secondary recrystallization become insufficient, so this is not preferable. If the content of Mn is more than 0.30%, at the time of slab heating, the Mn becomes difficult to dissolve, so this is not preferable. Further, if the content of Mn is more than 0.30%, the precipitated size of the inhibitors MnS and MnSe easily becomes coarser and the optimal distribution of size as inhibitors is detracted from, so this is not preferable. Therefore, the content of Mn is 0.01% or more and 0.30% or less, preferably 0.03% or more and 0.20% or less, more preferably 0.05% or more and 0.15% or less.

The contents of S (sulfur) and Se (selenium) are a total of 0.001% or more and 0.050% or less. S and Se form inhibitors together with the above-mentioned Mn. S and Se may both be contained in the slab, but it is sufficient at least one of either of them be contained in the slab. If the total of the contents of S and Se is outside the above range, a sufficient inhibitor effect cannot be obtained, so this is not preferable. Therefore, the contents of S and Se are a total of 0.001% or more and 0.050% or less, preferably 0.001% or more and 0.040% or less, more preferably 0.005% or more and 0.030% or less.

The content of acid soluble Al (acid soluble aluminum) is 0.01% or more and 0.05% or less. The acid soluble Al forms inhibitors required for producing high magnetic flux density grain-oriented electrical steel sheet. If the content of acid soluble Al is less than 0.01%, the inhibitor strength is low, so this is not preferable. If the content of acid soluble Al is more than 0.05%, the AlN precipitating as inhibitors becomes coarser and causes the inhibitor strength to drop, so this is not preferable. Therefore, the content of acid soluble Al is 0.01% or more and 0.05% or less, preferably 0.01% or more and 0.04% or less, more preferably 0.01% or more and 0.03% or less.

The content of N (nitrogen) is more than 0.002% or more and 0.020% or less. N forms the inhibitor AlN together with the above-mentioned acid soluble Al. If the content of N is outside the above range, a sufficient inhibitor effect cannot be obtained, so this is not preferable. Therefore, the content of N is 0.002% or more and 0.020% or less, preferably 0.004% or more and 0.015% or less, more preferably 0.005% or more and 0.010% or less.

The content of P (phosphorus) is 0.0400% or less. The lower limit includes 0%, but the detection limit is 0.0001%, so the substantive lower limit value is 0.0001%. P makes the texture after the primary recrystallization annealing a preferable one for magnetic flux density. That is, it is an element improving the magnetic characteristics. If less than 0.0001%, the effect of addition of P is not exhibited. On the other hand, if adding more than 0.0400%, the risk of breakage in cold rolling becomes higher and the sheet feeding remarkably deteriorates. The P content is preferably 0.0030% or more and 0.0300% or less, more preferably 0.0060% or more and 0.0200% or less.

The content of Cu (copper) is 0.05% or more and 0.50% or less. Cu forms a Cu segregated layer and acts to thermally stabilize the inhibitors, so is an important element in the present invention. The Cu content for strengthening the thermal stability of inhibitors by the Cu segregated layer has to be 0.05% or more. However, if the Cu content is more than 0.50%, it becomes a cause of deterioration of the hot embrittlement, so the sheet feeding remarkably deteriorates. Therefore, the Cu content is 0.05% or more and 0.50% or less, preferably 0.07% or more and 0.40% or less, more preferably 0.09% or more and 0.30% or less.

Further, the slab used for the production of the grain-oriented electrical steel sheet according to the present embodiment may contain, in addition to the above-mentioned elements, one or more elements selected from the group consisting of, by mass %, Sn: 0.50% or less, Cr: 0.500% or less, Bi: 0.0200% or less, Sb: 0.500% or less, Mo: 0.500% or less, and Ni: 0.500% or less in place of part of the Fe balance so as to improve the magnetic characteristics.

In one aspect, the content of Sn may be preferably 0.02% or more and 0.40% or less, more preferably 0.04% or more and 0.20% or less.

In one aspect, the content of Cr may be preferably 0.020% or more and 0.400% or less, more preferably 0.040% or more and 0.200% or less.

In one aspect, the content of Bi may be 0.0005% or more and is preferably 0.0005% or more and 0.0150% or less, more preferably 0.0010% or more and 0.0100% or less In one aspect, the content of Sb may be 0.005% or more and is preferably 0.005% or more and 0.300% or less, more preferably 0.005% or more and 0.200% or less.

In one aspect, the content of Mo may be 0.005% or more and is preferably 0.005% or more and 0.400% or less, more preferably 0.005% or more and 0.300% or less.

In one aspect, the content of Ni may be preferably 0.010% or more and 0.200% or less, more preferably 0.020% or more and 0.100% or less.

The slab is formed by casting molten steel adjusted to the chemical composition explained above. Note that, the method of casting the slab is not particularly limited. Further, in R&D, even if a steel ingot is formed by a vacuum melting furnace etc., a similar effect as the case where the slab is formed for the above constituents can be confirmed. Below, preferred aspects of the processes for producing grain-oriented electrical steel sheet from a slab will be further explained.

Hot Rolling Process

In this process, the slab is heated and hot rolled to obtain hot rolled steel sheet. The heating temperature of the slab, in one aspect, may be preferably 1280° C. or more or 1300° C. or more from the viewpoint of making the inhibitor constituents in the slab (for example, MnS, MnSe, AlN, etc.) dissolve and obtain the effect of the inhibitors well. The upper limit value of the heating temperature of the slab in this case is not particularly determined, but from the viewpoint of protection of the facilities is preferably 1450° C. The heating temperature of the slab is preferably less than 1280° C. or 1250° C. or less in one aspect from the viewpoints of lightening the load on the heating furnace at the time of hot rolling, reducing the amount of formation of scale, rendering control of inhibitors a subprocess, etc.

The heated slab is hot rolled to work it to hot rolled steel sheet. The thickness of the worked hot rolled steel sheet may, for example, be 1.8 mm or more from the viewpoint of the steel sheet temperature hardly dropping and precipitation of the inhibitors in the steel being able to be stably controlled and may be 3.5 mm or less from the viewpoint of being able to lower the rolling load in the cold rolling process.

Pickling Process

In this process, the hot rolled steel sheet is dipped in a pickling solution, or the hot rolled steel sheet is annealed to obtain a hot rolled annealed sheet, then the hot rolled annealed sheet is dipped in a pickling solution, to thereby obtain a pickled sheet. Pickling is performed at least once after the hot rolling and before primary recrystallization annealing. In one aspect, pickling is performed before a cold rolling process from the viewpoint of reducing roll wear in cold rolling.

The pH of the pickling solution is less than 7.0 in one aspect. If the pH is less than 7.0, the descaling effect is excellent, so this is preferable. On the other hand, the solution which can be practically prepared has a pH of −1.5 or more. The pH is preferably less than 2, more preferably less than 1.

As the acid constituent which the pickling solution contains, sulfuric acid, hydrochloric acid, nitric acid, etc. may be illustrated.

The temperature of the pickling solution is 15° C. or more and 100° C. or less in one aspect. If the temperature of the pickling solution is less than 15° C., the effect of descaling by the pickling becomes insufficient, so this is not preferable. If the temperature of the pickling solution is more than 100° C., handling of the pickling solution becomes difficult, so this is not preferable. The temperature of the pickling solution being 15° C. or more and 100° C. or less is advantageous from the viewpoint of making the metal constituents precipitate in the desired extents. The solution temperature may preferably be 50° C. or more and 90° C. or less, more preferably be 60° C. or more and 90° C. or less.

The time during which the steel sheet is dipped in the pickling solution in one aspect is 5 seconds or more and 200 seconds or less. If the time during which the steel sheet is dipped in the pickling solution is less than 5 seconds, the effect of descaling by the pickling will become insufficient, so this is not preferable. If time during which the steel sheet is dipped in the pickling solution is more than 200 seconds, the facilities will become long and large, so this is not preferable. The dipping time is preferably 10 seconds or more and 150 seconds or less, more preferably 20 seconds or more and 150 seconds or less.

Cold Rolling Process

In this process, the pickled sheet is cold rolled by one or more passes, or by a plurality of passes interspaced with process annealing, to obtain a cold rolled steel sheet. For example, if performing the cold rolling by a Sendzimir mill or other reverse rolling, the number of passes in the cold rolling is not particularly limited, but from the viewpoint of the production costs, it is preferably nine passes or less. The steel sheet may also be heat treated at 300° C. or so or less between passes of cold rolling, between rolling stands, or during rolling. Such heating is preferable on the point of enabling improvement of the magnetic characteristics of the final grain-oriented electrical steel sheet.

Process annealing may be performed one time or more between the plurality of passes. The temperature of the process annealing may be 900° C. or more and 1200° C. or less. The holding time of the process annealing is not particularly limited, but from the viewpoint of production costs is preferably 200 seconds or less. The pickling is preferably performed after the process annealing. The cumulative rolling reduction (%) of the steel sheet in the cold rolling process may be suitably designed so that a cold rolled steel sheet of the desired thickness is obtained. For example, it may be 80% to 95%. Note that, the "cumulative rolling reduction (%) of the steel sheet in the cold rolling process" is defined as [(hot rolled thickness-steel sheet thickness after final cold rolling pass)/hot rolled thickness]×100 in the case not including process annealing and is defined as [(steel sheet thickness after n-th processing annealing-steel sheet thickness after final cold rolling pass)/steel sheet thickness after n-th processing annealing]×100 in the case of performing process annealing "n" times (n≥1).

Primary Recrystallization Annealing Process

Next, in this process, the cold rolled steel sheet is annealed for primary recrystallization. The primary recrystallization annealing process includes a temperature raising process and a decarburization annealing process. The cold rolled steel sheet is subjected to the temperature raising process, then is annealed for decarburization in the decarburization annealing process. The operations from the temperature raising process to the decarburization annealing process are preferably performed consecutively. If making the temperature raising process a rapid temperature rise, it is possible to increase the amount of Goss-oriented grains of the cold rolled steel sheet before the finish annealing. Due to this, it is possible to efficiently perform secondary recrystallization close to Goss orientation in the finish annealing.

Temperature Raising Process

In the temperature raising process, the cold rolled steel sheet is raised to a desired decarburization annealing temperature. The rate of temperature rise is desirably suitably controlled in accordance with the temperature region. Below, an aspect illustrating the rate of temperature rise will be explained.

The average rate of temperature rise in the 30° C. to 400° C. temperature region in the temperature raising process is, in one aspect, more than 50° C./s and 1000° C./s or less. In the metal segregated layer of Cu and optionally further Mn made to precipitate by the pickling, if the dwell time at 30° C. to 400° C. is long, the above-mentioned effect of stabilization of the inhibitors ends up decreasing. There is a possibility that the metal constituents precipitated from the pickling solution have crystal structures different from the metal constituents precipitated by, for example, electrodeposition etc. This crystal structure may conceivably be a dense structure preventing gas permeation. However, it appears that this dense crystal structure ends up changing to a crystal structure with a high gas permeability in a relatively low temperature region. Such a trend is remarkable in the 30° C. to 400° C. temperature region. The cause of the change in crystal structure is not clear, but, for example, the change in the crystal lattice constant through oxidation of the metals may be mentioned. Whatever the case, to make the inhibitors stabler, control whereby the metal segregated layer does not change to a state with a high gas permeability, that is, shortening of the dwell time in the 30° C. to 400° C. temperature region, is necessary. By making the average rate of temperature rise in the 30° C. to 400° C. temperature region more than 50° C./s, oxidation of the metal constituents made to precipitate at the surface of the steel sheet is suppressed and the effect of suppression of breakdown of the inhibitors due to the metal constituents is obtained well. The average rate of temperature rise in the 30° C. to 400° C. temperature region is preferably more than 50° C./s, more preferably 60° C./s or more, still more preferably 100° C./s or more, even more preferably 200° C./s or more, and further preferably 300° C./s or more. The upper limit is not particularly set, but if rapidly heating in a relatively low temperature region, including room temperature (here 30° C. to 400° C.), the steel sheet will deteriorate in shape and the sheet will become difficult to feed. The upper limit of the rate of temperature rise at which a sheet can be fed is typically 1000° C./s. Therefore, the average rate of temperature rise in the 30° C. to 400° C. temperature region is, in one aspect 1000° C./s or less, preferably 800° C./s or less, more preferably 600° C./s or less.

In the temperature raising process, the average rate of temperature rise between 400° C. to 550° C. does not have to be specially controlled, but, for example, it may be similar to the one illustrated above as the average rate of temperature rise between 30° C. to 400° C. For example, after dwelling at 400±50° C. in range for 1 second or more, next the temperature may be raised at 550° C. or more. For example, dwelling at 400±50° C. in range for 1 second or more is sometimes preferable from the viewpoint of the magnetic characteristics.

In the temperature raising process, the average rate of temperature rise in the 550° C. to 700° C. temperature region is preferably made 100° C./s or more and 3000° C./s or less. Due to this, it is possible to increase the amount of Goss-oriented grains before finish annealing the cold rolled steel sheet and possible to improve the magnetic flux density of the final grain-oriented electrical steel sheet. Compared with a thick material, the effect of raising the rate of temperature rise is harder to obtain with a thin material as explained previously. Therefore, to obtain this effect well, the average rate of temperature rise in the temperature region of 550° C. to 700° C. is preferably 400° C./s or more, 500° C./s or more, 600° C./s or more, or 700° C./s or more. The higher the rate of temperature rise, the better, but if the rate of temperature rise becomes excessively large, while the Goss orientations will increase, the oriented grains {111}<112> which the Goss orientation feed on will end up decreasing and the risk of poor secondary recrystallization occurring will rise. Therefore, the upper limit of the average rate of temperature rise in the temperature region of 550° C. to 700° C. is preferably 2000° C./s or less, 1800° C./s or less, or 1600° C./s or less. By making average rate of temperature rise in at least the range of 550° C. to 700° C. the above range, reversal of dislocations in the steel sheet (that is, reduction of the density of dislocations in the steel sheet) will not proceed excessively greatly and primary recrystallization of oriented grains other than Goss-oriented grains can be kept from starting. Also, primary recrystallization of other oriented grains can be kept from ending up being completed before the primary recrystallization of Goss-oriented grains is completed.

If the metal constituents precipitate on the surface of the steel sheet, it will become harder for the decarburization reaction to proceed in the decarburization annealing process. The rate of temperature rise at 700° C. to 800° C. in the temperature raising process is preferably controlled to make decarburization proceed to the desired extent while obtaining the effect of suppression of breakdown of inhibitors. In one aspect, from the viewpoint of suppressing the production of the $SiO_2$ obstructing decarburization at the time of decarburization annealing, the average rate of temperature rise in the temperature region of 700° C. to 800° C. is preferably 400° C./s or more, more preferably 600° C./s or more, still more preferably 800° C./s or more. The upper limit of the average rate of temperature rise in the temperature region of 700° C. to 800° C. is not particularly prescribed, but from the viewpoint of the cost of facilities and production costs, it may be, for example, 2500° C./s or less, preferably 2000° C./s or less, more preferably 1800° C./s or less. Such a rapid temperature rise can, for example, be performed by using an ohmic heating method or induction heating method.

The temperature raising process may also be performed by several apparatuses.

The rate of temperature rise can be measured by measuring the steel sheet temperature using a radiant thermometer etc. Note that the method of measurement of the steel sheet temperature is not particularly limited. However, if measurement of the steel sheet temperature is difficult and accurate estimation of the temperature of the start point of temperature rise and the end point of temperature rise at which the rate of temperature rise should be controlled is difficult, it is also possible to compare heat patterns of the temperature rise and cooling so as to estimate these temperatures. Further, the entry side temperature and exit side temperature of steel sheet to the temperature raising apparatus in the temperature raising process may be made the start point of temperature rise and the end point of temperature rise.

Decarburization Annealing Process

After the temperature raising process, the decarburization annealing process is performed. In a usual embodiment, the decarburization annealing process includes soaking treatment. The soaking treatment may be performed in a mixed atmosphere containing hydrogen and/or oxygen at, for example, 900° C. or less or 750° C. to 900° C. The decarburization annealing temperature may be the same as the end temperature of temperature rise of the temperature raising process explained above or may be a temperature higher than that or lower than that. If the end temperature of temperature rise of the temperature raising process is a temperature lower than the decarburization annealing temperature, the steel sheet may be further heated before the decarburization annealing. On the other hand, if the end temperature of temperature rise of the temperature raising process is higher than the decarburization annealing temperature, it is also possible to cool the steel sheet before the decarburization annealing by heat dissipation treatment, gas cooling treatment, etc. Furthermore, after the temperature raising process, it is also possible to cool the steel sheet to a lower temperature than the decarburization annealing temperature, then reheat at the decarburization annealing process.

The soaking treatment may be performed one time or more. For example, if performing the soaking treatment two times in a first soaking treatment and a second soaking treatment, after the end of the first soaking treatment, the second soaking treatment may be performed by cooling the steel sheet once (for example, cooling down to room temperature), then reheating. Alternatively, it is also possible to perform the second soaking treatment without cooling. From the viewpoint of making the coating film adhesion of the grain-oriented electrical steel sheet excellent, a forsterite film ($Mg_2SiO_4$) is desirably efficiently formed on the surface of the steel sheet after finish annealing. However, in soaking treatment, sometimes $Fe_2Si_4O$ obstructing the formation of this forsterite film is produced. If performing a first soaking treatment and second soaking treatment, in the first soaking treatment, even if $Fe_2Si_4O$ is produced, this is reduced in the second soaking treatment causing the production of $SiO_2$ whereby a forsterite film is formed well in the following finish annealing process and the coating film adhesion can be improved.

Improvement of the coating film adhesion is advantageous for improvement of the coating film tension and therefore improvement of the magnetic characteristics. Note that even if $SiO_2$ is produced in the second soaking treatment, since there has already been sufficient progress in decarburization in the first soaking treatment, there is no problem with the decarburization ability of the $SiO_2$.

The oxygen potential in the atmosphere of the soaking treatment, that is, the ratio ($P_{H_2O}/P_{H_2}$) between the water vapor partial pressure $P_{H_2O}$ and the hydrogen partial pressure $P_{H_2}$ in the atmosphere, is preferably 0.2 or more, or 0.3 or more, or 0.4 or more from the viewpoint of making the internal oxidation proceed well and forming a uniform oxide film on the surface of the steel sheet and is preferably 0.6 or less or 0.55 or less from the viewpoint of obtaining good magnetic characteristics. Further, for example, if performing the first soaking treatment and second soaking treatment, preferably the $P_{H2O}/P_{H2}$ ratio of the first soaking treatment is made the above range and the $P_{H2O}/P_{H2}$ ratio of the second soaking treatment is made, for example, less than 0.2, 0.1 or less, or 0.08 or less. The lower limit of the $P_{H2O}/P_{H2}$ ratio of the second soaking treatment in this case is not particularly limited, but is for example 0.01 or more or 0.02 or more from the viewpoint of the ease of process control.

In one aspect, the decarburization annealing process may include a first soaking treatment performed at 750° C. to 900° C. and a second soaking treatment performed at 900° C. to 1000° C. In one aspect, the decarburization annealing process may include a first soaking treatment performed at a temperature of 750° C. to 900° C. in an atmosphere of an oxygen potential ($P_{H2O}/P_{H2}$) of 0.2 to 0.6 and a second soaking treatment after the first soaking treatment at a temperature of 900° C. to 1000° C. in an atmosphere of an oxygen potential ($P_{H2O}/P_{H2}$) of less than 0.2.

In the temperature raising process of the primary recrystallization annealing process, the dew point temperature of the atmosphere between 30° C. to 800° C. is preferably −50° C. or more and 0° C. or less. The dew point temperature is preferably 0° C. or less, −5° C. or less, or −10° C. or less from the viewpoint of suppressing oxidation of the metal in the steel sheet and suppressing formation of $SiO_2$ due to external oxidation to cause good progression of decarburization. The dew point temperature may, for example, be −50° C. or more or −40° C. or more from the viewpoint of cause good progression of internal oxidation.

Nitriding

After the cold rolling process and before the finish annealing, nitriding may be further performed for the purpose of inhibitor strengthening. In one aspect, the nitriding may be performed after the soaking treatment and before the finish annealing. For example, it may be performed in the order of the soaking treatment-nitriding-finish annealing, the order of the first soaking treatment-second soaking treatment-nitriding-finish annealing, or the order of the first soaking treatment-nitriding-second soaking treatment-finish annealing. The nitriding may be performed in a nitridable gas (for example, gas containing ammonia) atmosphere.

Finish Annealing Process

Next, the steel sheet after the primary recrystallization annealing process (primary recrystallized annealed sheet) is finish annealed for the purpose of forming the primary coating and secondary recrystallization. In a typical embodiment, the primary recrystallized annealed sheet before the finish annealing is coated with an annealing separator having MgO as its main constituent for the purpose of preventing the steel sheets from sticking to each other, forming the primary coating film, controlling the secondary recrystallization behavior, etc. The annealing separator is generally coated and dried on the surface of the steel sheet in the state of an aqueous slurry, but the electrostatic coating method etc. may also be used.

The finish annealing may, for example, be performed by using a batch type heating furnace etc. to heat treat a coil shaped steel sheet. Furthermore, purification treatment raising the coil shaped steel sheet to a temperature of 1200° C. or so, then holding it there may be applied for the purpose of better reducing the core loss of the finally obtained grain-oriented electrical steel sheet. In finish annealing, the temperature is generally raised from room temperature or so. Further, there are various rates of temperature rise in finish annealing. The conditions of the finish annealing are not particularly limited. For example, from the viewpoints of the productivity and general restrictions on facilities, the rate of temperature rise may be made 5° C./h to 100° C./h, but other known heat patterns may also be employed. The pattern of the cooling process is also not particularly limited.

The atmospheric gas composition in the finish annealing is not particularly limited. In the process of progression of secondary recrystallization, the gas may also be a mixed gas of nitrogen and hydrogen. The atmosphere may be a dry atmosphere or may be a wet atmosphere. The atmosphere of the purification annealing may for example be dry hydrogen gas.

Flattening Annealing Process

For the purpose of imparting insulation ability and tension to the steel sheet after the finish annealing, an insulation coating (for example, an insulation coating having aluminum phosphate or colloidal silica as its main constituent) is coated on the surface of the steel sheet. The constituents of the insulation coating may be suitably selected so that the desired insulation ability and tension are imparted to the steel sheet. Next, flattening annealing may be performed for the purpose of baking on the insulation coating and flattening the shape of the steel sheet resulting from the finish annealing.

Treatment to control the magnetic domains may be further performed in accordance with the application of the obtained grain-oriented electrical steel sheet etc.

Grain-oriented electrical steel sheet excellent in magnetic characteristics can be produced by the processes illustrated above. The grain-oriented electrical steel sheet able to be produced by the method of the present embodiment can be worked into a wound core or stacked core at the time of production of a transformer and used for the desired application.

Magnetic Characteristics of Grain-Oriented Electrical Steel Sheet

The grain-oriented electrical steel sheet produced by the method of the present embodiment is excellent in magnetic characteristics. Specifically, even in a thin material, an excellent secondary recrystallized structure is obtained and the magnetic flux density is improved. Here, the evaluation items of the magnetic flux density B8 value and core loss W17/50 of the grain-oriented electrical steel sheet produced by the method of the present embodiment will be explained. The magnetic flux density is an indicator of the degree of Goss orientation. Here, the magnetic flux density B8 value is the magnetic flux density when applying a magnetic field of 800 A/m at 50 Hz to grain-oriented electrical steel sheet. B8 is an indicator of the degree of alignment to Goss orientation. If B8 is low, a good core loss cannot be obtained. If B8 is 1.88 T or more, a good core loss is obtained so this is preferable. Further, the core loss W17/50 (W/kg) indicates the core loss of a sample at the time of a frequency of 50 Hz and a maximum magnetic flux density of 1.7 T. The magnetic flux density B8 value and W17/50 are values found based on the single sheet magnetic characteristic test method prescribed in JIS C2556 (Single Sheet Tester: SST). Note that, in R&D, if a steel ingot is formed in a vacuum melting furnace etc., it becomes difficult to obtain a test piece of an equivalent size as actual production. In this case, for example, it is also possible to obtain a test piece of a width 60 mm×length 300 mm and measure the characteristics based on the single sheet magnetic characteristic test method. At this time, it is also possible to multiply the obtained results by a correction coefficient so that measurement values equal to the method based on the Epstein test prescribed in JIS C2550 are obtained.

Note that, in the above-mentioned embodiment, the case of applying the method for producing grain-oriented electrical steel sheet according to one aspect of the present invention to a thin material (0.15 mm to 0.23 mm) was illustrated, but the method according to the present invention can also be applied to other thicknesses.

EXAMPLES

Below, the illustrative aspects of the present invention will be further explained by giving examples, but the present invention is not limited to the following examples.

Production of Grain-Oriented Electrical Steel Sheet

Examples 1 to 14 and Comparative Examples 1 to 6

Slabs having the slab compositions shown in Table 1 were obtained. The slabs were heated to 1100° C. to 1400° C., then were hot rolled to obtain thickness 2.0 mm to 3.0 mm hot rolled steel strips. Next, the hot rolled steel strips were heated to 1120° C. to make them recrystallize, then were annealed at 900° C. to obtain hot rolled annealed steel strips. The hot rolled annealed steel strips were pickled under the pickling conditions shown in Table 2, then were cold rolled to the final product thicknesses of 0.19 mm to 0.22 mm.

Next, primary recrystallization annealing was performed at 800° C. to 850° C. for around 100 seconds to 200 seconds. Note that the primary recrystallization annealing is comprised of a temperature raising process and a decarburization annealing process. The annealing atmosphere in each case was made a mixed atmosphere of hydrogen and nitrogen or a nitrogen atmosphere. In the temperature raising process, the dew point at the temperature region of 30° C. to 800° C. was made −30° C. to 0° C. The rate of temperature rise at 30° C. to 400° C. was as shown in Table 2. In the decarburization annealing process, the atmosphere was controlled to 800° C. to 850° C., and the oxygen potential was controlled to 0.3 to 0.6. The rate of temperature rise of the temperature raising process was controlled to an average rate of temperature rise of 500° C./s to 2000° C./s in the range of 550° C. to 700° C. and of 800° C./s to 2000° C./s in the range of 700° C. to 800° C. After the decarburization annealing, Slab Nos. 1 and 4 to 6 were subjected to the second soaking treatment, that is, the second soaking treatment was performed at 900° C. to 1000° C. for around 10 seconds to 50 seconds. The annealing atmosphere of the second soaking treatment was also made a mixed atmosphere of hydrogen and nitrogen and the oxygen potential was controlled to 0.1 or less. On the other hand, Slab Nos. 2 to 3 were not subjected to the second soaking treatment but were nitrided.

Next, finish annealing was performed. Specifically, the surfaces of the steel sheets after the primary recrystallization annealing were coated with an annealing separator having magnesium oxide (MgO) as its main constituent. Next, the primary recrystallization annealed steel sheets on which the annealing separator was coated were raised in temperature until 1200° C. to prepare the finish annealed steel sheets. The annealing atmosphere of the finish annealing was made a mixed atmosphere of hydrogen and nitrogen.

Next, the finish annealed steel sheets were subjected to an insulation coating forming process. Specifically, the surfaces of the steel sheets after the finish annealing were coated with an insulation coating forming solution having colloidal silica and a phosphate as its main constituents and coating was baked on.

Grain-oriented electrical steel sheets were obtained by the above processes.

From the prepared grain-oriented electrical steel sheets, width 60 mm×length 300 mm evaluation samples were obtained. The thus obtained samples were evaluated for B8 and W17/50 based on JIS C2556.

Samples with a B8 of less than 1.88 were deemed unable to give the secondary recrystallized structure preferable for the magnetic characteristics and were deemed NG (No Good). Further, samples with a value of W17/50 of 0.890 W/kg or more were judged to suffer from deterioration of the core loss due to a good secondary recrystallized structure not being obtained and were deemed NG in magnetic characteristics. On the other hand, the magnetic characteristics of samples with a value of W17/50 of 0.840 W/kg or more and less than 0.890 W/kg were deemed F (Fine), the magnetic characteristics of samples with a value of W17/50 of 0.790 W/kg or more and less than 0.840 W/kg were deemed G (Good), and the magnetic characteristics of samples with a value of W17/50 of less than 0.790 W/kg were deemed VG (Very Good).

The results are shown in Table 2.

TABLE 1

| | Slab Composition (mass %) | | | | | | | | | | | | | | |
|---|---|---|---|---|---|---|---|---|---|---|---|---|---|---|---|
| Slab no. | C | Si | Mn | S | Se | Acid soluble Al | N | P | Cu | Sn | Cr | Bi | Sb | Mo | Ni |
| 1 | 0.09 | 3.25 | 0.11 | 0.028 | 0.002 | 0.01 | 0.005 | 0.0200 | 0.11 | — | 0.180 | — | 0.010 | 0.010 | — |
| 2 | 0.06 | 3.40 | 0.10 | 0.009 | — | 0.03 | 0.009 | 0.0150 | 0.25 | 0.06 | 0.110 | — | — | — | — |
| 3 | 0.06 | 3.25 | 0.07 | 0.011 | 0.006 | 0.03 | 0.005 | 0.0090 | 0.10 | — | 0.050 | — | — | 0.005 | |
| 4 | 0.08 | 3.31 | 0.07 | 0.023 | — | 0.02 | 0.010 | 0.0120 | 0.09 | 0.10 | 0.060 | 0.0010 | — | — | 0.040 |
| 5 | 0.07 | 3.45 | 0.15 | 0.020 | 0.007 | 0.02 | 0.010 | 0.0190 | 0.20 | 0.18 | 0.150 | 0.0100 | 0.050 | 0.010 | 0.020 |
| 6 | 0.05 | 3.55 | 0.11 | 0.011 | — | 0.02 | 0.005 | 0.0080 | 0.20 | — | 0,140 | — | — | 0.200 | 0.060 |
| 7 | 0.06 | 3.25 | 0.05 | 0.014 | — | 0.03 | 0.010 | 0.0150 | 0.27 | — | 0.050 | — | — | 0.025 | 0.080 |
| 8 | 0.05 | 3.34 | 0.12 | 0.008 | — | 0.03 | 0.009 | 0.0270 | 0.23 | — | — | — | — | — | — |
| 9 | 0.08 | 3.46 | 0.07 | 0.020 | 0.006 | 0.03 | 0.008 | 0.0150 | 0.19 | — | — | — | — | — | — |
| 10 | 0.09 | 3.40 | 0.08 | 0.024 | — | 0.02 | 0.010 | 0.0120 | 0.12 | — | — | — | — | — | — |
| 11 | 0.06 | 3.25 | 0.12 | 0.008 | — | 0.02 | 0.008 | 0.0130 | 0.33 | — | — | — | — | — | — |
| 12 | 0.08 | 3.25 | 0.07 | 0.025 | — | 0.02 | 0.008 | 0.0180 | 0.45 | — | — | — | — | — | — |
| 13 | 0.09 | 3.40 | 0.08 | 0.024 | — | 0.02 | 0.010 | 0.0090 | 0.56 | — | — | — | — | — | — |

TABLE 2

| | | Pickling solution | | | | | | | | Rate of | | | |
|---|---|---|---|---|---|---|---|---|---|---|---|---|---|
| | Slab no. | Cu concen-tration (g/L) | Mn concen-tration (g/L) | Cu and Mn concen-tration total (g/L) | Ni concen-tration (g/L) | pH | Solution temp. (° C.) | Dipping time (s) | Final thick-ness (mm) | temp. rise in 30 to 400° C. temperature region (° C./s) | Magnetic flux density (B8) | Core loss (W17/50) | Evalu-ation |
| Ex. 1 | 1 | 0.05 | 0.03 | 0.08 | <0.01 | <1 | 55 | 30 | 0.19 | 500 | 1.92 | 0.80 | G |
| Ex. 2 | 2 | 0.11 | 0.23 | 0.34 | <0.01 | <1 | 70 | 40 | 0.19 | 500 | 1.92 | 0.79 | G |
| Ex. 3 | 3 | 0.05 | 0.18 | 0.23 | 0.08 | <1 | 60 | 60 | 0.19 | 400 | 1.93 | 0.79 | G |
| Ex. 4 | 4 | 0.07 | 0.29 | 0.36 | 0.03 | <1 | 80 | 60 | 0.19 | 400 | 1.95 | 0.78 | VG |
| Ex. 5 | 5 | 1.56 | 0.05 | 1.61 | 0.05 | <1 | 70 | 60 | 0.19 | 300 | 1.96 | 0.77 | VG |
| Ex. 6 | 6 | 1.55 | 0.04 | 1.59 | 0.15 | <1 | 60 | 90 | 0.19 | 300 | 1.96 | 0.78 | VG |
| Ex. 7 | 7 | 1.05 | <0.0001 | 1.05 | <0.01 | <1 | 90 | 90 | 0.19 | 600 | 1.96 | 0.77 | VG |
| Ex. 8 | 8 | 2.05 | 0.45 | 2.50 | <0.01 | <1 | 90 | 20 | 0.22 | 700 | 1.91 | 0.85 | F |
| Ex. 9 | 9 | 0.02 | <0.0001 | 0.02 | <0.01 | <1 | 90 | 20 | 0.22 | 450 | 1.90 | 0.85 | F |
| Ex. 10 | 10 | 1.55 | 0.33 | 1.88 | <0.01 | <1 | 90 | 150 | 0.22 | 250 | 1.90 | 0.87 | F |
| Ex. 11 | 11 | 0.10 | 0.05 | 0.013 | <0.01 | <1 | 60 | 30 | 0.22 | 60 | 1.90 | 0.85 | F |
| Ex. 12 | 12 | 0.12 | 0.06 | 0.018 | <0.01 | <1 | 70 | 30 | 0.22 | 60 | 1.90 | 0.85 | F |
| Ex. 13 | 4 | 0.07 | 0.27 | 0.34 | 0.02 | <1 | 75 | 60 | 0.19 | 900 | 1.91 | 0.80 | G |
| Ex. 14 | 12 | 0.0005 | <0.0001 | 0.0005 | <0.01 | <1 | 80 | 50 | 0.22 | 700 | 1.90 | 0.85 | F |
| Comp. Ex. 1 | 6 | <0.0001 | <0.0001 | <0.0001 | 0.03 | <1 | 60 | 80 | 0.22 | 300 | 1.87 | 1.01 | NG |
| Comp. Ex. 2 | 7 | 1.22 | 0.45 | 1.67 | 0.05 | <1 | 60 | 80 | 0.22 | 50 | 1.87 | 1.05 | NG |
| Comp. Ex. 3 | 13 | 1.25 | 0.43 | 1.55 | 0.02 | <1 | 60 | 80 | 0.22 | 50 | 1.84 | 1.10 | NG |
| Comp. Ex. 4 | 1 | <0.0001 | <0.0001 | <0.0001 | <0.01 | <1 | 55 | 30 | 0.19 | 500 | 1.85 | 1.07 | NG |
| Comp. Ex. 5 | 2 | 5.15 | 0.40 | 5.55 | <0.01 | <1 | 70 | 40 | 0.19 | 500 | 1.85 | 1.03 | NG |
| Comp. Ex. 6 | 3 | 0.05 | 0.18 | 0.23 | 0.08 | <1 | 60 | 60 | 0.19 | 30 | 1.84 | 1.09 | NG |

INDUSTRIAL APPLICABILITY

The grain-oriented electrical steel sheet obtained by the method of the present disclosure can be suitably used for various applications in which excellent magnetic characteristics are demanded.

The invention claimed is:

1. A method for producing a grain-oriented electrical steel sheet, the method comprising:

a hot rolling process of heating and hot rolling a slab having a slab composition comprising, by mass %, C: 0.02% or more and 0.10% or less, Si: 2.5% or more and 4.5% or less, Mn: 0.01% or more and 0.30% or less, a total of one or both of S and Se: 0.001% or more and 0.050% or less, acid soluble Al: 0.01% or more and 0.05% or less, N: 0.002% or more and 0.020% or less, P: 0.0400% or less, and Cu: 0.05% or more and 0.50% or less and having a balance of Fe and impurities to obtain a hot rolled steel sheet, a process of obtaining a pickled sheet by either dipping the hot rolled steel sheet in a pickling solution, or annealing the hot rolled steel sheet to obtain a hot rolled annealed sheet and then dipping the hot rolled annealed sheet in the pickling solution, the pickling solution containing 0.0001 g/L or more and 5.00 g/L or less of Cu, a cold rolling process of cold rolling the pickled sheet to obtain a cold rolled steel sheet, a thickness of the cold rolled steel sheet being 0.15 mm or more and 0.23 mm or less, a primary recrystallization annealing process of annealing the cold rolled steel sheet to obtain a primary recrystallized annealed sheet, the primary recrystallization annealing process including a temperature raising process to a decarburization annealing temperature, and a decarburization annealing process, wherein an average rate of temperature rise in a temperature region of 30° C. to 400° C. in the temperature raising process is more than 50° C./s and 1000° C./s or less, a finish annealing process of coating a surface of the primary recrystallized annealed sheet with an annealing separator containing MgO, then finish annealing the sheet to obtain a finish annealed sheet, and a flattening annealing process of coating the finish annealed sheet with an insulation coating to obtain a coated finish annealed sheet, then annealing the coated finish annealed sheet.

2. The method for producing a grain-oriented electrical steel sheet according to claim 1, wherein a total content of Cu and Mn in the pickling solution is 0.01 g/L or more and 5.00 g/L or less.

3. The method for producing a grain-oriented electrical steel sheet according to claim 1, wherein in the pickling process, a pH of the pickling solution is-1.5 or more and less than 7.0, a temperature of the pickling solution is 15° C. or more and 100° C. or less, and the dipping in the pickling solution is performed for 5 seconds or more and 200 seconds or less.

4. The method for producing a grain-oriented electrical steel sheet according to claim 1, wherein the pickling solution contains Ni: 0.01 g/L or more and 5.00 g/L or less.

5. The method for producing a grain-oriented electrical steel sheet according to claim 1, wherein in the temperature raising process in the primary recrystallization annealing process, a dew point in the temperature region of 30° C. to 800° C. is-50° C. to 0° C.

6. The method for producing a grain-oriented electrical steel sheet according to claim 1, wherein an average rate of temperature rise in a temperature region of 550° C. to 700° C. in the temperature raising process is 100° C./s or more and 3000° C./s or less.

7. The method for producing a grain-oriented electrical steel sheet according to claim 1, wherein an average rate of temperature rise in a temperature region of 700° C. to 800° C. in the temperature raising process is 400° C./s or more and 2500° C./s or less.

8. The method for producing a grain-oriented electrical steel sheet according to claim 1, wherein the decarburization annealing process includes a soaking treatment performed at a temperature of 750° C. to 900° C. in an atmosphere of an oxygen potential ($P_{H2O}/P_{H2}$) of 0.2 to 0.6.

9. The method for producing a grain-oriented electrical steel sheet according to claim 1, wherein the decarburization annealing process includes a first soaking treatment performed at a temperature of 750° C. to 900° C. in an atmosphere of an oxygen potential ($P_{H2O}/P_{H2}$) of 0.2 to 0.6 and a second heat treatment performed after the first heat treatment at a temperature of 900° C. to 1000° C. in an atmosphere of an oxygen potential ($P_{H2O}/P_{H2}$) of less than 0.2.

10. The method for producing a grain-oriented electrical steel sheet according to claim 1, further comprising performing nitriding after the cold rolling process and before the finish annealing process.

11. The method for producing a grain-oriented electrical steel sheet according to claim 1, wherein the slab composition contains, in place of part of the Fe, by mass %, one or more elements selected from Sn: 0.50% or less,
Cr: 0.500% or less,
Bi: 0.0200% or less,
Sb: 0.500% or less,
Mo: 0.500% or less, and
Ni: 0.500% or less.

12. The method for producing a grain-oriented electrical steel sheet according to claim 1, wherein a magnetic flux density B8 measured according to JIS C2556 is 1.88 T or more, wherein the magnetic flux density B8 is defined as the magnetic flux density when applying a magnetic field of 800 A/m at 50 Hz to the grain-oriented electrical steel sheet.

13. The method for producing a grain-oriented electrical steel sheet according to claim 1, wherein a core loss W17/50 measured according to JIS C2556 is less than 0.890 W/kg, wherein the core loss W17/50 is defined as the core loss at a time of a frequency of 50 Hz and a maximum magnetic flux density of 1.7T.

14. The method for producing a grain-oriented electrical steel sheet according to claim 1, wherein:

a magnetic flux density B8 measured according to JIS C2556 is 1.88 T or more, wherein the magnetic flux density B8 is defined as the magnetic flux density when applying a magnetic field of 800 A/m at 50 Hz to the grain-oriented electrical steel sheet, and a core loss W17/50 measured according to JIS C2556 is less than 0.890 W/kg, wherein the core loss W17/50 is defined as the core loss at a time of a frequency of 50 Hz and a maximum magnetic flux density of 1.7T.

* * * * *